US009741482B2

(12) United States Patent
Weisburgh et al.

(10) Patent No.: US 9,741,482 B2
(45) Date of Patent: Aug. 22, 2017

(54) ELECTROMAGNETIC ACTUATOR WITH REDUCED PERFORMANCE VARIATION

(71) Applicant: Cooper Technologies Company, Houston, TX (US)

(72) Inventors: Rose Ellen Weisburgh, Washington, DC (US); Michael Patrick Culhane, Delafield, WI (US); Mark Allan Juds, New Berlin, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/702,280

(22) Filed: May 1, 2015

(65) Prior Publication Data

US 2016/0322147 A1 Nov. 3, 2016

(51) Int. Cl.
*H01F 7/16* (2006.01)

(52) U.S. Cl.
CPC ... *H01F 7/1615* (2013.01); *H01F 2007/1692* (2013.01)

(58) Field of Classification Search
CPC ..... H01F 7/122; H01F 7/1615
USPC ..... 335/126, 253
See application file for complete search history.

(56) References Cited

U.S. PATENT DOCUMENTS 4,056,255 A * 11/1977 Lace ..... F16K 31/082 251/129.15
4,072,918 A 2/1978 Read, Jr.
4,127,835 A * 11/1978 Knutson ..... H01F 7/1615 310/30
4,419,643 A * 12/1983 Ojima ..... H01F 7/1615 335/230
4,462,013 A * 7/1984 Ueda ..... H01F 7/1615 335/229
5,365,210 A * 11/1994 Hines ..... H01F 7/1615 335/173
5,389,910 A * 2/1995 Abel ..... H01F 7/1615 335/237
5,627,504 A * 5/1997 Kleinhappl ..... H01F 7/1615 251/129.15
5,897,096 A * 4/1999 Nakano ..... F02M 3/075 251/129.15
5,959,519 A * 9/1999 Gobel ..... H01F 7/1615 335/132

(Continued)

*Primary Examiner* — Alexander Talpalatski
(74) *Attorney, Agent, or Firm* — Ziolkowski Patent Solutions Group, SC

(57) ABSTRACT

An electromagnetic actuator includes a housing and a bobbin positioned within the housing and secured relative thereto so as to be centered therein, the bobbin comprising a bobbin formed of a non-magnetic material. The electromagnetic actuator also includes a coil wound about the bobbin and a magnetic circuit comprising a plurality of actuator components positioned within the housing and on or adjacent to the bobbin. The actuator components include a permanent magnet that induces a magnetic flux flow through the magnetic circuit so as to generate a magnetic force, and an armature selectively movable within an opening formed through the bobbin responsive to the magnetic force and to current selectively provided to the coil. The bobbin locates and centers the components of the magnetic circuit about the central axis and provides a bearing surface for the armature as it moves within the opening formed through the bobbin.

23 Claims, 3 Drawing Sheets

(56) References Cited

U.S. PATENT DOCUMENTS

| | | | | |
|---|---|---|---|---|
| 6,218,921 | B1 * | 4/2001 | Eberts | H01H 71/322 335/172 |
| 6,392,516 | B1 * | 5/2002 | Ward | H01F 7/081 335/220 |
| 6,816,048 | B2 * | 11/2004 | Morita | H01F 7/1615 218/154 |
| 7,053,742 | B2 * | 5/2006 | Lanni | H01F 7/081 335/220 |
| 8,222,980 | B2 * | 7/2012 | Yamagata | H01H 50/023 335/126 |
| 8,269,588 | B2 | 9/2012 | Sohn | |
| 8,669,836 | B2 * | 3/2014 | Kulke | H01F 7/1615 335/229 |
| 8,674,795 | B2 | 3/2014 | Reuber | |
| 8,692,636 | B2 | 4/2014 | Reuber | |
| 2003/0234377 | A1 | 12/2003 | Herbert et al. | |
| 2004/0032309 | A1 * | 2/2004 | Kajino | H01H 51/065 335/126 |
| 2005/0029480 | A1 | 2/2005 | Cook | |
| 2007/0194872 | A1 | 8/2007 | Pfister et al. | |
| 2007/0241298 | A1 | 10/2007 | Herbert et al. | |
| 2011/0057753 | A1 * | 3/2011 | Irwin | H01F 7/088 335/257 |
| 2012/0091233 | A1 | 4/2012 | Canepa-Anson et al. | |
| 2012/0112860 | A1 * | 5/2012 | Gruden | H01F 7/122 335/229 |

* cited by examiner

ELECTROMAGNETIC ACTUATOR WITH REDUCED PERFORMANCE VARIATION

BACKGROUND OF THE INVENTION

Embodiments of the present invention relate generally to electromagnetic actuators and, more particularly, to an electromagnetic actuator having a modular construction that provides for easy assembly of the actuator and allows for the use of components therein with relaxed dimensional tolerances, without affecting the performance of the actuator.

Electromagnetic actuators are devices commonly found in power equipment and provide working motion courtesy of an internal electromagnetic field, with the motion of the actuator providing a control or switching function in such power equipment. Electromagnetic actuators provide the movement used for actuation by exposing a free moving plunger or armature to the magnetic field created by energizing a static wire coil. The field attracts the plunger or armature that, in turn, moves, thus providing the required actuation. Varying degrees of actuation functionality can be achieved with an electromagnetic actuator, ranging from simple single-cycle, single-speed actions to fairly sophisticated control of both actuation time and positioning.

One type of commonly used electromagnetic actuator is a permanent magnet actuator, which makes use of one or more permanent magnets and electric energy to control positioning of a plunger therein. Permanent magnet actuators may be configured such that the plunger thereof is held at a stroke position due to magnetic energy of the permanent magnet, with electric energy being applied to the wire coil to move the plunger to a different stroke position.

One drawback common to many electromagnetic actuators is the costs associated with manufacturing and assembling the actuator. That is, many existing actuators include a large number of machined components (e.g., plates, bobbin, permanent magnet, a flux transfer ring, a flux transfer plate, armature, spacer, housing, etc.) of complex shape that require tight tolerances in order to provide for a sufficient holding force in the actuator to properly align/space the components—such that the actuator can function without suffering from reduced performance. The machining of these components with such tight tolerances leads to increased manufacturing costs. Additionally, the complex shape of these components can add to the difficulty of assembling the actuator—leading to an increased assembly/production time for the actuator.

Therefore, it is desirable to provide an electromagnetic actuator assembled from components that have more relaxed tolerances than those required in existing actuators, with such components not affecting the holding force and other performance related characteristics of the actuator. It is further desirable for the components in such an actuator to be assembled in a simple, less time-consuming manner, such that assembly costs of the actuator can be reduced.

BRIEF DESCRIPTION OF THE INVENTION

In accordance with one aspect of the present invention, an electromagnetic actuator includes a housing defining an interior volume and having a central axis extending axially therethrough, and a bobbin positioned within the interior volume of the housing and secured relative thereto so as to be centered about the axis, the bobbin comprising a bobbin formed of a non-magnetic material. The electromagnetic actuator also includes a coil wound about the bobbin and a magnetic circuit comprising a plurality of actuator components that are positioned at least partially within the interior volume of the housing and are positioned on or adjacent to the bobbin, the plurality of actuator components including a permanent magnet that induces a magnetic flux flow through the magnetic circuit so as to generate a magnetic force and an armature selectively movable within an opening formed through the bobbin responsive to the magnetic force and to a current selectively provided to the coil. The bobbin locates and centers the plurality of components of the magnetic circuit about the central axis and provides a bearing surface for the armature as it moves within the opening formed through the bobbin.

In accordance with another aspect of the present invention, an electromagnetic actuator includes a housing defining an interior volume and having a central axis extending axially therethrough, and a bobbin positioned within the interior volume of the housing and secured relative thereto so as to be centered about the axis. The electromagnetic actuator also includes one or more coils wound about the bobbin and a magnetic circuit positioned on and adjacent to the bobbin, with the magnetic circuit further including a top plate, a tube positioned adjacent the top plate, a permanent magnet positioned opposite the tube from the top plate, a bottom plate positioned adjacent the permanent magnet on a side thereof opposite the tube, and an armature extending axially from the top plate and out past the bottom plate, the armature being positioned radially inward from each of the top plate, the tube, the permanent magnet, and the bottom plate. The top plate, the tube, the permanent magnet, and the bottom plate are all aligned in a stacked arrangement, such that magnetic flux induced by the permanent magnet flows through the magnetic circuit in an axial direction.

In accordance with yet another aspect of the present invention, an electromagnetic actuator includes a housing defining an interior volume and having a central axis extending axially therethrough, and a bobbin positioned within the interior volume of the housing and secured relative thereto so as to be centered about the axis. The electromagnetic actuator also includes one or more coils wound about the bobbin and a magnetic circuit comprising a plurality of actuator components that are positioned at least partially within the interior volume of the housing and are positioned on or adjacent to the bobbin, with the plurality of actuator components including a permanent magnet that induces a magnetic flux flow through the magnetic circuit so as to generate a magnetic force and an armature selectively movable within an opening formed through the bobbin responsive to the magnetic force generated by magnetic flux resulting from the permanent magnet and a current selectively provided to the one or more coils. The electromagnetic actuator further includes a center rod screwed into a bottom wall of the armature such that a position of the center rod relative to the armature is variable based on an amount by which the center rod is screwed into the armature, with a movement of the armature within the opening formed through the bobbin being limited by the amount by which the center rod is screwed into the armature.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
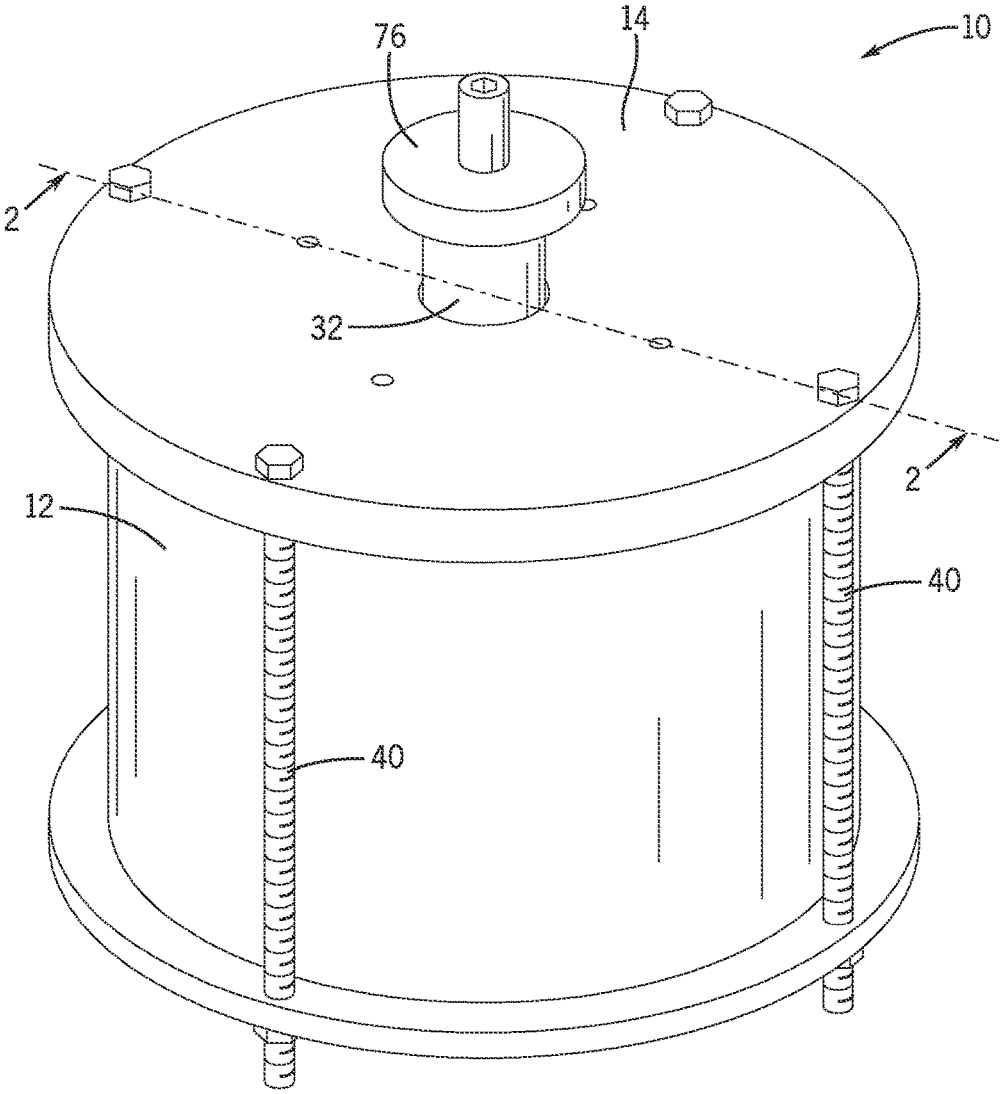
FIG. 1 is a perspective view of an electromagnetic actuator according to an embodiment of the invention.
Figure 2:
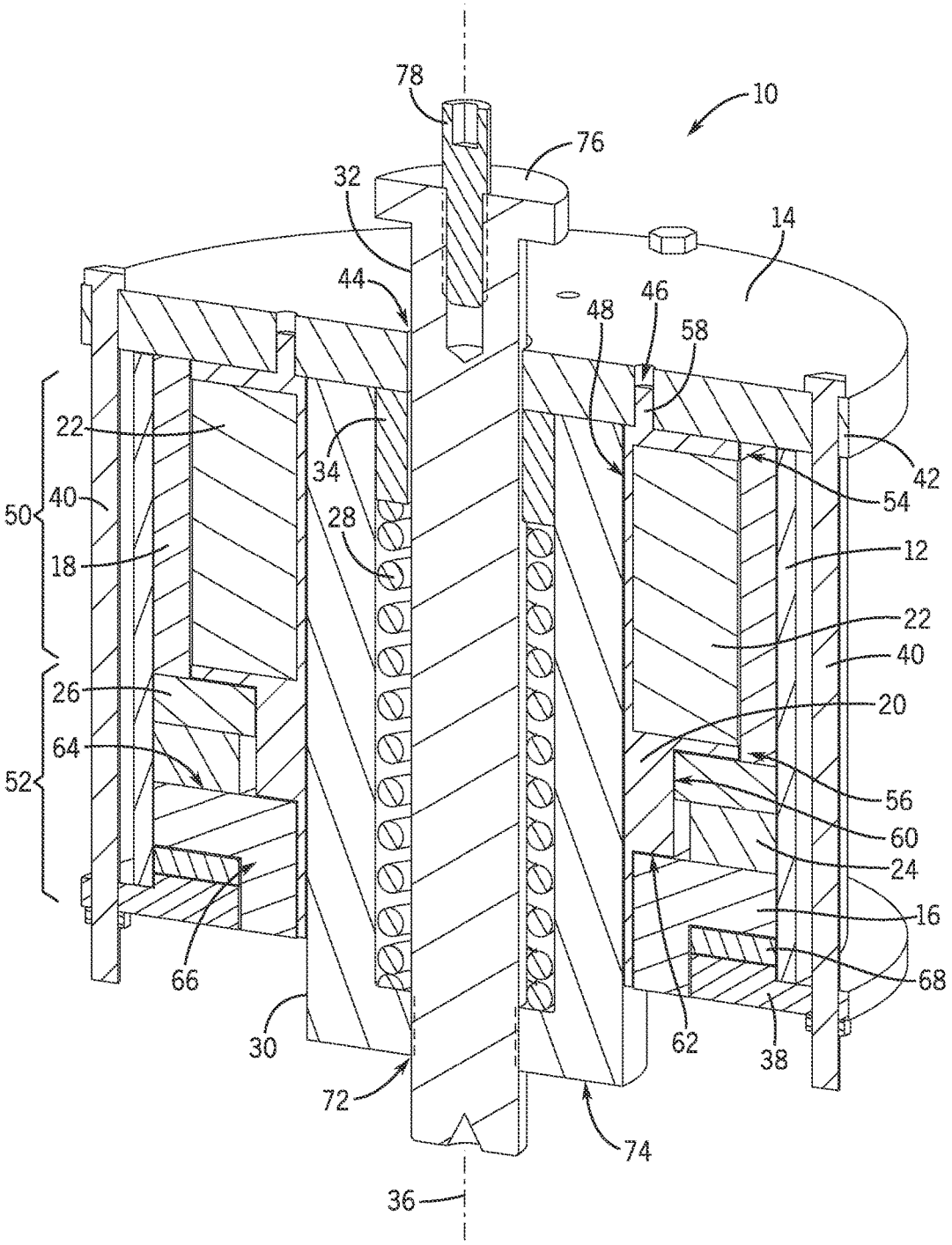
FIG. 2 is a cross-sectional view of the electromagnetic actuator of FIG. 1 taken along line 2-2, illustrating the armature and the center rod in a first axial position.

Referring to FIGS. 1 and 2, an electromagnetic actuator 10 is shown according to an embodiment of the invention. The primary components that form the electromagnetic actuator 10 include a housing 12, a top plate 14, a bottom plate 16, a tube 18, a bobbin 20 and coil 22, a permanent magnet 24, a flux transfer plate 26, a spring 28, an armature 30, a center rod 32, and an optional spacer 34. As will be described in further detail below, each of these components is specifically constructed to provide an electromagnetic actuator 10 that is easy to machine and assemble, without the components affecting performance related characteristics of the actuator.

The housing 12 of the electromagnetic actuator 10 is of a hollow construction with a substantially cylindrical form and is positioned about an axis 36 of the actuator, with the housing 12 being formed of an easily workable non-magnetic material, such as an aluminum alloy (e.g., 6061) or polymer material. In an exemplary embodiment, the housing 12 is closed at a lower end by a lower cap or cover 38 and at an upper end by top plate 14. In another embodiment, an upper cover (not shown) may be integrally formed on the housing 12 on the upper end thereof. The lower cover 38 may be secured to the housing 12 by any suitable means well known to those skilled in the art to which this invention pertains, such as a snap fit engagement. The lower cover 38 may be formed from the same non-magnetic material as the housing 12 (e.g., 6061) or from a different, suitable non-magnetic material. In one embodiment, the diameters of the lower cover 38 and the top plate 14 may extend to be larger than the housing 12, where tie rods 40 can be utilized to secure the lower cover 38 and the top plate 14 (such that no upper cover is needed)—with the tie rods 40 being secured to a lip 42 of top 14 that extends radially outward past housing 12. In an alternate embodiment where an upper cover (not shown) is provided on the housing 12, it is recognized that the tie rods 40 would not be required.

The top plate 14 is formed of an easily machineable soft magnetic material, such as C12L14 steel for example, and includes a rod opening 44 formed therein capable of receiving the center rod 32 of the actuator 10. In an exemplary embodiment, the top plate 14 also includes one or more locating holes or features 46 formed therein that provide for the alignment and positioning of the bobbin 20 relative thereto. In one embodiment, the locating holes or features 46 is in the form of a cylindrical depression or hole formed in the top plate 14, although a groove could also be utilized.

As shown in FIG. 2, the bobbin 20 of actuator 10 is structured so as to enable winding of a coil 22 thereabout and to also enable the placement of other actuator components relative thereto in a desired position (i.e., guiding/alignment of the components). The bobbin 20 is formed so as to have a wall 48 that forms a cylindrical opening through the bobbin 20, with a number of formations being shaped/formed on the wall 48 that extend radially outward from the wall 48. While these formations on the bobbin 20 result in a bobbin 20 having a somewhat complex shape, the bobbin 20 is formed as a molded component such that manufacturing of the bobbin 20 is made easier. In an exemplary embodiment, the bobbin 20 is formed of a nylon material, although it is recognized that other moldable non-magnetic materials having a very low magnetic permeability might also be suitable for forming the bobbin 20.

The bobbin 20 is described herein as generally including a coil portion 50 and an alignment portion 52 thereon. The coil portion 50 of the bobbin 20 is defined by a pair of flanges 54, 56 formed on the wall 48 that extend radially outward therefrom, with a coil 22 (or coils) of the actuator 10 being wound about the wall 48 in the space defined by the flanges. The flanges 54, 56 can be identified as a top flange 54 and a center flange 56, and the top flange 54 of the bobbin 20 is positioned on the top plate 14 and is secured thereto. In one embodiment, a protrusion 58 (e.g., cylindrical protrusion) is formed on the top flange 54 of the bobbin 20 that interfits with the hole 46 (or groove) formed in the top plate 14 to align the bobbin 20 relative to the top plate 14, such that the bobbin 20 is axially aligned with the axis 36. However, while top plate 14 is described as including locating holes 46 therein that mate with protrusion 58, it is recognized that such locating holes and protrusions are not required to secure the bobbin 20 within the actuator 10 and/or for the actuator 10 to function properly, as they may only be used in the manufacturing process to hold and locate the bobbin 20 during a coil winding operation.

As indicated above, each of the flanges 54, 56 of the bobbin 20 extends radially outward from the wall 48, and the flanges 54, 56 are formed such that a gap is present between an end of the flanges 54, 56 and an inner surface of the housing 12. The tube 18 of actuator 10 is positioned in this gap, with the tube 18 having a thickness essentially equal to a width of the gap formed between the flanges 54, 56 and housing 12. In one embodiment, the tube 18 is formed of an easily machineable soft magnetic material, such as C12L14 steel for example, and functions to further secure the bobbin 20 within housing 12, while also securing the coil 22 about the coil portion 50 of bobbin 20 and preventing any unwinding thereof.

The alignment portion 52 of the bobbin 20 is defined by the center flange 56 and by a stepped configuration of the wall 48 on the end of the bobbin 20 opposite coil portion 50. The wall 48 of bobbin 20 includes a section 60 (adjacent center flange) having increased thickness, with a step 62 being formed in the alignment portion 52 where this wall section 60 of increased thickness is reduced down to a lesser thickness. The alignment portion 52 therefore includes a number of features on/with which components of the actuator 10 may be placed and aligned.

As shown in FIG. 2, the flux transfer plate 26 and the permanent magnet 24 of actuator 10 are positioned about the wall section 60 with the increased thickness, with each of the flux transfer plate 26 and the permanent magnet 24 having a ring shaped construction (either formed as a singular piece or made up of separate arc segments or regular polygon segments (e.g., hexagonal segments) pieced together to form a ring) with a width essentially equal to width of a gap formed between the wall section 60 of bobbin 20 and the housing 12—such that the flux transfer plate 26 and the permanent magnet 24 are generally held in place by the bobbin 20 so as to be axially aligned with the axis 36 of the housing 12. The flux transfer plate 26 abuts a lower surface of the center flange 56, with the permanent magnet 24 being stacked onto the flux transfer plate 26. The flux transfer plate 26 is formed of an easily machineable soft magnetic material, such as C12L14 steel for example, while the permanent magnet 24 is preferably formed of a material having a high magnetic remanence, such as neodymium-boron-iron, samarium-cobalt, or ferrite, or Alnico, or any other high magnetic remanence material.

Referring still to FIG. 2, it is seen that the bottom plate 16 of the actuator 10 is positioned such that it abuts the permanent magnet 24 and the step 62 formed in the alignment portion 52 of bobbin 20. The bottom plate 16 includes a flat surface 64 that abuts the permanent magnet 24 and the step 62 of bobbin 20 and is parallel thereto, as well a cylindrical protrusion 66 formed adjacent the wall 48 of bobbin 20—with the cylindrical protrusion 66 extending axially downward (i.e., away from step 62) toward lower cover 38 of the actuator 10. The bottom plate 16 is positioned about the bobbin 20 and has an outer diameter essentially equal to an inner diameter of the housing 12, such that the bottom plate 16 is generally held in place by the bobbin 20 and housing 12 so as to be axially aligned with the axis 36 of the housing 12. According to an exemplary embodiment, the bottom plate 16 is formed of an easily machineable soft magnetic material, such as C12L14 steel, for example.

Based on the description provided above and that which is shown in FIG. 2, it is understood that the top plate 14, the tube 18, the flux transfer plate 26, the permanent magnet 24, and the bottom plate 16 are provided in a stacked arrangement. According to an exemplary embodiment, a fastening component 68 (such as a compliant material or spring) is positioned adjacent bottom plate 16—about the cylindrical protrusion 66 thereof—with the fastening component 68 compressing and holding the stacked arrangement of components in place and in contact with one another within the housing 12. According to an exemplary embodiment, the fastening component 68 may be formed of a snap ring, wave spring and/or washer that collectively provide for such securing of the stacked components. The lower cover 38 of the actuator 10 is formed so as to interfit with and to press on the fastening component 68, thereby closing off the actuator 10 at the lower end thereof. Beneficially, the above described fastening method (utilizing fastening component 68) can accommodate large variations in the tolerance stack-up from the components of the actuator 10.

As further shown in FIG. 2, the armature 30 and center rod 32 of the actuator 10 are disposed along the axis 36 of the housing 12, with the center rod 32 being formed of a structurally suitable material such as nonmagnetic stainless steel of very low magnetic permeability, and the armature 30 being formed of a structurally suitable soft magnetic material such as C12L14 steel, for example. The armature 30 is positioned so as to pass through a hole 70 (FIG. 3) formed in the lower cover 38 and is received within the hollow cylindrical opening of bobbin 20 defined by wall 48, with the armature 30 slideably engaging the bobbin 20, as the nylon (or other suitable material) from which the bobbin 20 is formed provides a material appropriate for facilitating sliding movement of the armature 30. The center rod 32 is received within the armature 30 via a hole 72 formed in a bottom wall 74 of the armature 30, with the center rod 32 extending through the armature 30 and out through the rod opening 44 formed in the top plate 14 of the actuator 10. The center rod 32 includes a head 76 either formed thereon or attached thereto (e.g., a separate nut) that serves as end stop for the center rod 32 when traveling axially relative to the housing 12, with the head 76 also providing for engagement of the actuator 10 to an op-rod coupler 78. In an exemplary embodiment, the center rod 32 screws directly into the armature 30 via a threading (not shown) formed thereon and in hole 72, such that a positioning of the rod 32 relative to the armature 30 can be varied as desired by screwing the rod into or out of the armature 30—with the center rod 32 thus functioning as a "stroke control bolt." In an alternate embodiment, the center rod 32 utilizes a shoulder that conforms to the armature 30 and fixes the stroke to a constant length.

The spring 28 of actuator 10 is provided as a helical compression spring 28 of nonmagnetic material that is positioned about the center rod 32 and within the armature 30, with the spring 28 engaging the bottom wall 74 of the armature 30. According to one embodiment, a spacer 34 is provided on the end of the spring 28 opposite the armature bottom wall 74 and extends between the spring 28 and the top plate 14 to hold the spring 28 in position on the center rod 32—with the spacer being formed of a non-magnetic material (e.g., nylon). The spacer 34 is used when the spring 28 is made of a magnetic material to prevent reducing the magnetic force when magnetic flux is carried in the spring 28. The center rod 32 passes through spacer 34 and slideably engages the spacer 34, with the nylon (or other suitable material) from which the spacer 34 is formed providing a material appropriate for facilitating sliding movement of the center rod 32 relative thereto. An alternate configuration of actuator 10 eliminates the spacer 34 when the spring 28 is made from a non-magnetic material such as stainless steel, with the spring 28 then extending up to the top plate 14.

In operation, the armature 30 is maintained in the position shown in FIG. 2 under the influence of magnetic force generated by magnetic flux induced by the permanent magnet 24, after such magnet is properly magnetized. This magnetic flux passes from the magnet 24 through the stacked arrangement of the top plate 14, tube 18, flux transfer plate 26, bottom plate 16, and the armature 30 and returns to the magnet (which collectively form a magnetic circuit)—with the magnetic flux traveling axially through each component rather than radially. The force exerted by the spring 28 and the op-rod coupler 78 on the wall 74 of the armature 30 is insufficient to overcome the magnetic force on the armature 30 resulting from this flow of magnetic flux through the armature 30 induced by the permanent magnet 24. This magnetic flux flow is maximized by the presence in this magnetic circuit of only highly magnetic permeable and high magnetic saturation materials.

Figure 3:
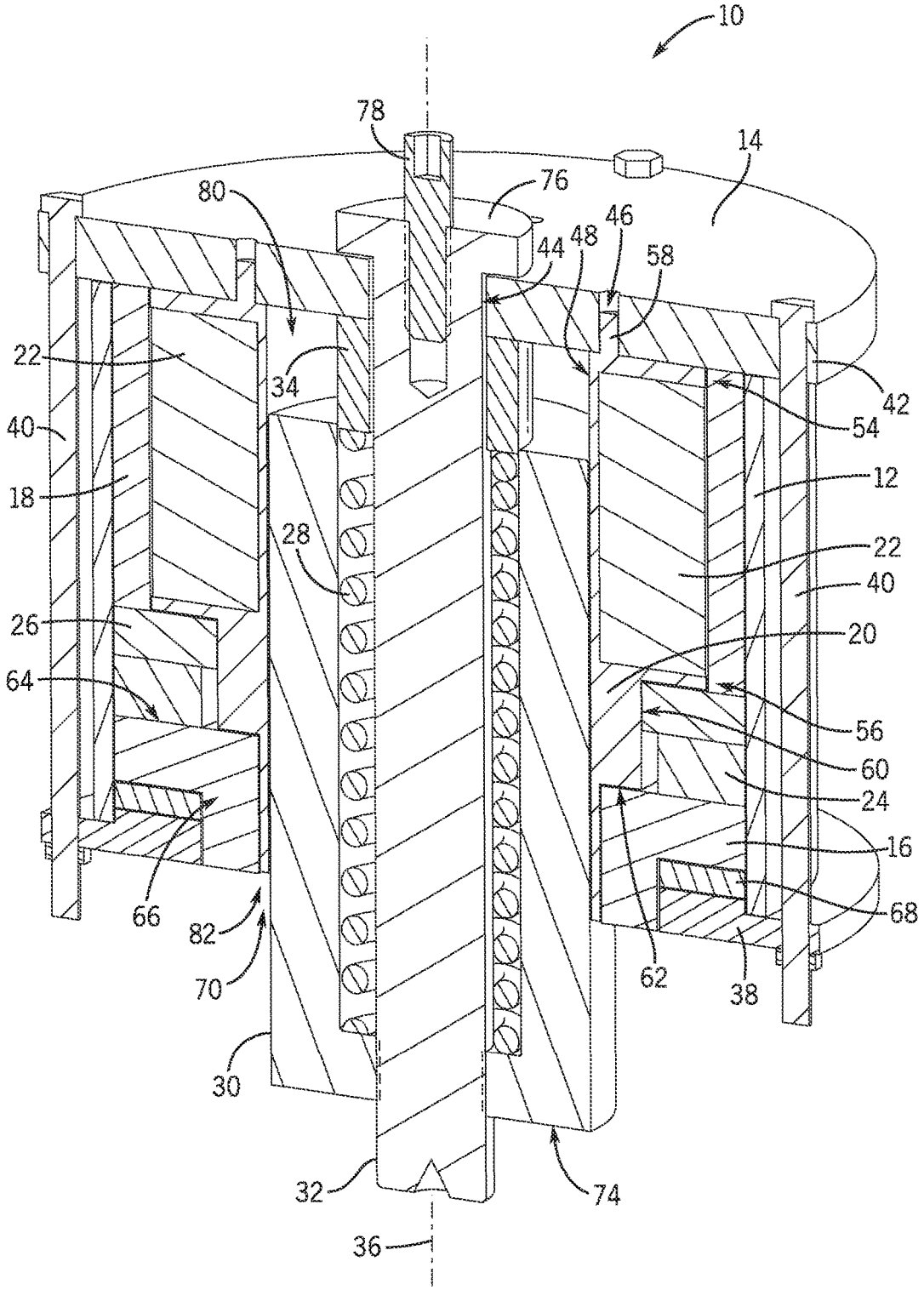
FIG. 3 is a cross-sectional view of the electromagnetic actuator of FIG. 1 taken along line 2-2, illustrating the armature and the center rod in a second axial position.

The armature 30 may be moved axially to a second position by application of an appropriate pulse of current to the coil 22, as indicated in FIG. 3. In the event of application of such a pulse to the coil 22 in a direction such as to reduce the net flow of magnetic flux through the armature 30, the magnetic force on that armature 30 becomes less than the force applied by the spring 28 and the op-rod coupler 78, and the armature 30 is moved axially, with the bobbin 20 serving as a bearing surface for the armature 30 so as to allow axial translation therein. The center rod 32 moves with the armature 30, as does any external linkage (not shown) which may be connected thereto, with the amount of translation of the armature 30 and the center rod 32 being controllable based on the manner/depth which the center rod 32 is screwed into the armature 30—i.e., translation of the armature 30 will stop when the head 76 of center rod 32 abuts the top plate 14. Thereafter, with the armature 30 in its second position, an air gap 80 thus formed beneath the armature 30 is sufficiently greater than a radial gap 82 between the armature 30 and the bottom plate 16 through which the bulk of the magnetic flux flows through. As a result, the magnetic flux flow through the armature 30 is at a sufficiently reduced level that the net magnetic force on the armature 30 is less than the force of the spring 28. Consequently, the armature 30 is stable in the second position.

In an appropriate configuration of the actuator 10 with adequate coil windings and adequate current applied so as to sufficiently increase the net magnetic flux flow through the armature 30, a magnetic force could be developed which would overcome the force of the spring 28 and the op-rod coupler 78, and return the armature 30 from its second stable position to its first stable position. Thereafter, termination of the current pulse through the coil 22 would leave the armature 30 firmly held in the first stable position under the influence of magnetic force developed by magnetic flux flow induced by the magnet 24 alone.

Beneficially, the construction of the electromagnetic actuator 10 shown and described in FIGS. 1-3 provides for an actuator having a modular construction that is easily assembled and allows for the use of components therein with relaxed dimensional tolerances. The columnar stacked arrangement of the top plate 14, the tube 18, the flux transfer plate 26, the permanent magnet 24, and the bottom plate 16—which are each constructed as simple ring-shaped components that easily stack together around the bobbin via a short/easy assembly process—provides an axial flowpath through each component for the magnetic flux instead of a radial flowpath, such that the inner and outer diameters of each of these ring-shaped components do not need to be tightly controlled as they do in many actuator designs. For example, the tolerances on these components may vary by 0.010 to 0.015 inches or larger, without affecting the holding force or other performance related characteristics of the actuator. The actuator will perform efficiently and effective and consistently as long as the armature outer diameter and the bobbin inner diameter are tightly and accurately toleranced and as long as the tolerance between the outer diameter of the armature 30 and the inner diameter of the bottom plate 16 are tightly toleranced, with it being recognized that construction of the bobbin as a molded component and construction of the armature as a simple cylindrical component provides for tight tolerancing thereof in a simple and inexpensive fashion. The "L" shaped cross section of the bottom plate 16 increases the flux transfer area between the bottom plate 16 and the armature 30, with it being recognized that the cylindrical protrusion 66 of the bottom plate can be sized to maintain latching force even if the bobbin wall thickness increases or the armature outer diameter decreases.

Furthermore, the stacked arrangement of the top plate 14, the tube 18, the flux transfer plate 26, and the bottom plate 16 are tightly held together by the fastening component 68 and by the magnetic flux from the permanent magnet 24. This means that no matter the thickness of the components, they are tightly held together to maintain consistent actuator performance.

In the electromagnetic actuator 10, the bobbin 20 is not only used to hold the coil 22, but it is also used as a bearing surface for the armature 30, and a locating/alignment tool for all of the other components in the magnetic circuit (i.e., the top plate 14, the tube 18, the flux transfer plate 26, the permanent magnet 24, and the bottom plate 16). To create fluid motion in a typical actuator as it operates, it is necessary to have fine surface finishes on the armature 30 and the steel component which it translates relative to; however, in electromagnetic actuator 10, only one machined surface (i.e., the armature 30) has to be tightly controlled to get fluid motion, as the bobbin 20 is used as the second smooth component—with the bobbin 20 being a molded part on which it is much easier to control the surface finish.

Additionally, by locating the spring 28 inside of the actuator (i.e., shielded by the armature 30, the top plate 14 and housing 12), the spring 28 is protected from metal debris that may be attracted to the permanent magnet 24. Thus, beneficially, no debris should be able to interfere with the operation of the actuator 10.

Still further, as the center rod 32 screws directly into the armature 30 and is adjustable relative thereto, screwing of the center rod 32 into and out of the armature 30 as desired allows for different travel lengths (i.e., center rod 32 functions as a stroke control bolt). Accordingly, the actuator 10 is structured as a "modular" actuator that is easily adaptable for multiple different strokes, such that the actuator is able to accommodate any of several different mechanisms connected thereto. An alternate embodiment of actuator 10 is structured as a modular actuator with a constant stroke.

Therefore, according to an embodiment of the invention, an electromagnetic actuator includes a housing defining an interior volume and having a central axis extending axially therethrough, and a bobbin positioned within the interior volume of the housing and secured relative thereto so as to be centered about the axis, the bobbin comprising a bobbin formed of a non-magnetic material. The electromagnetic actuator also includes a coil wound about the bobbin and a magnetic circuit comprising a plurality of actuator components that are positioned at least partially within the interior volume of the housing and are positioned on or adjacent to the bobbin, the plurality of actuator components including a permanent magnet that induces a magnetic flux flow through the magnetic circuit so as to generate a magnetic force and an armature selectively movable within an opening formed through the bobbin responsive to the magnetic force and to a current selectively provided to the coil. The bobbin locates and centers the plurality of components of the magnetic circuit about the central axis and provides a bearing surface for the armature as it moves within the opening formed through the bobbin.

According to another embodiment of the invention, an electromagnetic actuator includes a housing defining an interior volume and having a central axis extending axially therethrough, and a bobbin positioned within the interior volume of the housing and secured relative thereto so as to be centered about the axis. The electromagnetic actuator also includes one or more coils wound about the bobbin and a magnetic circuit positioned on and adjacent to the bobbin, with the magnetic circuit further including a top plate, a tube positioned adjacent the top plate, a permanent magnet positioned opposite the tube from the top plate, a bottom plate positioned adjacent the permanent magnet on a side thereof opposite the tube, and an armature extending axially from the top plate and out past the bottom plate, the armature being positioned radially inward from each of the top plate, the tube, the permanent magnet, and the bottom plate. The top plate, the tube, the permanent magnet, and the bottom plate are all aligned in a stacked arrangement, such that magnetic flux induced by the permanent magnet flows through the magnetic circuit in an axial direction.

According to yet another embodiment of the invention, an electromagnetic actuator includes a housing defining an interior volume and having a central axis extending axially therethrough, and a bobbin positioned within the interior volume of the housing and secured relative thereto so as to be centered about the axis. The electromagnetic actuator also includes one or more coils wound about the bobbin and a magnetic circuit comprising a plurality of actuator components that are positioned at least partially within the interior volume of the housing and are positioned on or adjacent to the bobbin, with the plurality of actuator components including a permanent magnet that induces a magnetic flux flow through the magnetic circuit so as to generate a magnetic force and an armature selectively movable within an opening formed through the bobbin responsive to the magnetic force generated by magnetic flux resulting from the permanent magnet and a current selectively provided to the one or more coils. The electromagnetic actuator further includes a center rod screwed into a bottom wall of the armature such that a position of the center rod relative to the armature is variable based on an amount by which the center rod is screwed into the armature, with a movement of the armature within the opening formed through the bobbin being limited by the amount by which the center rod is screwed into the armature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic actuator comprising:

a housing defining an interior volume and having a central axis extending axially therethrough;

a bobbin positioned within the interior volume of the housing and secured relative thereto so as to be centered about the axis, the bobbin comprising first end and a second end opposite the first end and being formed of a non-magnetic material;

a coil wound about the bobbin; and a magnetic circuit comprising a plurality of actuator components that are positioned at least partially within the interior volume of the housing and are positioned on or adjacent to the bobbin, the plurality of actuator components including:

a permanent magnet that induces a magnetic flux flow through the magnetic circuit so as to generate a magnetic force; and;

an armature selectively movable within an opening formed through the bobbin responsive to the magnetic force and to a current selectively provided to the coil;

wherein the bobbin locates and centers the plurality of components of the magnetic circuit about the central axis;

wherein the bobbin provides a bearing surface for the armature as it moves within the opening formed through the bobbin; and wherein the permanent magnet comprises a ring-shaped magnet that is positioned on the bobbin so as to encircle the bobbin and so as to be located between the first end and the second end of the bobbin.

2. The electromagnetic actuator of claim 1 wherein the bobbin comprises:

a wall defining the opening formed through the bobbin;

a pair of flanges extending radially outward from the wall in a spaced apart relationship, with the coil wound about the wall in a location between the pair of flanges; and a step feature positioned adjacent a center flange of the pair of flanges.

3. The electromagnetic actuator of claim 2 wherein the plurality of actuator components further includes:

a top plate positioned on a lip of the housing adjacent an upper end of the housing;

a tube positioned adjacent the top plate and radially outward from the bobbin in a gap formed between an end of each of the pair of flanges and the housing;

a flux transfer plate positioned adjacent the tube and on a surface of the center flange opposite from the coil, with the permanent magnet positioned adjacent the flux transfer plate on a side thereof opposite the tube and the center flange; and a bottom plate positioned adjacent a lower end of the housing and adjacent the permanent magnet on a side thereof opposite the flux transfer plate;

wherein the top plate, the tube, the flux transfer plate, the permanent magnet, and the bottom plate are aligned in a stacked arrangement, such that magnetic flux flows axially through the plurality of actuator components of the magnetic circuit.

4. The electromagnetic actuator of claim 1 further comprising a center rod secured to a bottom wall of the armature, such that the center rod moves with the armature when the armature moves within the opening formed through the bobbin.

5. The electromagnetic actuator of claim 4 wherein the center rod is screwed into the bottom wall of the armature such that a position of the center rod relative to the armature is variable based on an amount by which the center rod is screwed into the armature; and wherein the center rod comprises a head or nut formed thereon or attached thereto, and wherein a movement of the armature within the opening formed through the bobbin is limited by the head or the nut, with a location of the head or nut being determined based on the distance by which the center rod is screwed into the armature, or by a distance by which the nut is screwed onto the center rod.

6. The electromagnetic actuator of claim 4 wherein the center rod comprises a shoulder that conforms to the armature and fixes a stroke movement of the center rod to a constant length.

7. The electromagnetic actuator of claim 4 further comprising a spring positioned about the center rod, the spring also being positioned within the armature so as to engage the bottom wall of the armature.

8. The electromagnetic actuator of claim 7 further comprising a spacer positioned on an end of the spring opposite the bottom wall of the armature to hold the spring in position on the center rod.

9. The electromagnetic actuator of claim 3 further comprising a fastening component positioned adjacent the bottom plate and about a protrusion thereof, the fastening component holding the stacked arrangement in place and in contact with one another within the housing.

10. The electromagnetic actuator of claim 3 wherein the top plate includes an opening formed therein that receives a protrusion formed on the bobbin, so as to align the bobbin with the top plate and within the housing so as to be centered about the axis.

11. The electromagnetic actuator of claim 1 wherein the bobbin is formed of a nylon material or another non-magnetic and electrically non-conductive material.

12. An electromagnetic actuator comprising:

a housing defining an interior volume and having a central axis extending axially therethrough;

a bobbin positioned within the interior volume of the housing and secured relative thereto so as to be centered about the axis;

one or more coils wound about the bobbin; and a magnetic circuit positioned on and adjacent to the bobbin, the magnetic circuit comprising:

a top plate;

a tube positioned adjacent the top plate;

a permanent magnet positioned opposite the tube from the top plate;

a bottom plate positioned adjacent the permanent magnet on a side thereof opposite the tube, such that the permanent magnet is positioned between the tube and the bottom plate; and an armature extending axially from the top plate and out past the bottom plate, the armature being positioned radially inward from each of the top plate, the tube, the permanent magnet, and the bottom plate;

wherein the top plate, the tube, the permanent magnet, and the bottom plate are all aligned in a stacked arrangement, such that magnetic flux induced by the permanent magnet flows through the magnetic circuit in an axial direction; and wherein the permanent magnet encircles the bobbin so as to be positioned radially outward therefrom and such that the permanent magnet is disposed between the bobbin and the housing.

13. The electromagnetic actuator of claim 12 wherein the bobbin comprises:

a cylindrical wall defining the opening formed through the bobbin;

a pair of flanges extending radially outward from the wall in a spaced apart relationship, with the one or more coils wound about the wall in a location between the pair of flanges; and a step feature positioned adjacent a center flange of the pair of flanges, the step being defined by a section of the wall having an increased thickness as compared to a remainder of the wall;

wherein the wall, the pair of flanges and the step feature of the bobbin locate and center the tube, the permanent magnet, and the bottom plate about the central axis.

14. The electromagnetic actuator of claim 13 wherein the magnetic circuit further comprises a flux transfer plate positioned between the tube and the permanent magnet, with the permanent magnet positioned adjacent the flux transfer plate on a side thereof opposite the tube.

15. The electromagnetic actuator of claim 13 wherein the cylindrical wall defines an opening formed through the bobbin that is centered about the central axis, with the wall of the bobbin providing a bearing surface for the armature as it moves within the opening formed through the bobbin responsive to a magnetic force generated by magnetic flux resulting from the permanent magnet and a current selectively provided to the one or more coils.

16. The electromagnetic actuator of claim 12 further comprising a center rod secured to a bottom wall of the armature, the center rod being screwed into the bottom wall of the armature such that a position of the center rod relative to the armature is variable based on an amount by which the center rod is screwed into the armature;

wherein the center rod comprises a head or nut formed thereon or attached thereto, and wherein a movement of the armature within the opening formed through the bobbin is limited by the head or nut of the center rod.

17. The electromagnetic actuator of claim 12 further comprising a center rod secured to a bottom wall of the armature wherein the center rod comprises a shoulder that conforms to the armature and fixes a stroke movement of the center rod to a constant length.

18. The electromagnetic actuator of claim 16 further comprising a spring positioned about the center rod and within the armature so as to be shielded from an external environment.

19. An electromagnetic actuator comprising:

a housing defining an interior volume and having a central axis extending axially therethrough;

a bobbin positioned within the interior volume of the housing and secured relative thereto so as to be centered about the axis;

one or more coils wound about the bobbin;

a magnetic circuit comprising a plurality of actuator components that are positioned at least partially within the interior volume of the housing and are positioned on or adjacent to the bobbin, the plurality of actuator components including:

a ring-shaped permanent magnet that induces a magnetic flux flow through the magnetic circuit so as to generate a magnetic force, the permanent magnet being positioned on and radially outward from the bobbin so as to encircle the bobbin and be disposed between the bobbin and the housing; and an armature selectively movable within an opening formed through the bobbin responsive to the magnetic force generated by magnetic flux resulting from the permanent magnet and a current selectively provided to the one or more coils; and a center rod secured to a bottom wall of the armature, the center rod being screwed into the bottom wall of the armature such that a position of the center rod relative to the armature is variable based on an amount by which the center rod is screwed into the armature;

wherein a movement of the armature within the opening formed through the bobbin is limited by the amount by which the center rod is screwed into the armature.

20. The electromagnetic actuator of claim 19 wherein the plurality of actuator components further includes:

a top plate;

a tube positioned adjacent the top plate;

a flux transfer plate positioned adjacent the tube on a side thereof opposite the top plate, with the permanent magnet positioned adjacent the flux transfer plate on a side thereof opposite the tube; and a bottom plate positioned adjacent the permanent magnet on a side thereof opposite the flux transfer plate;

wherein the top plate, the tube, the flux transfer plate, the permanent magnet, and the bottom plate are aligned in a stacked arrangement, such that magnetic flux flows axially through the plurality of actuator components of the magnetic circuit; and wherein the bobbin locates and centers the plurality of components of the magnetic circuit about the central axis, providing for the stacked arrangement of the top plate, the tube, the flux transfer plate, the permanent magnet, and the bottom plate.

21. The electromagnetic actuator of claim 1 wherein the bobbin provides a bearing surface for the armature, along an entire length of the bobbin, as the armature moves within the opening formed through the bobbin.

22. An electromagnetic actuator comprising:

a housing defining an interior volume and having a central axis extending axially therethrough;

a bobbin positioned within the interior volume of the housing and secured relative thereto so as to be centered about the axis, the bobbin being formed of a non-magnetic material and comprising:

a wall defining an opening formed through the bobbin;

a pair of flanges extending radially outward from the wall in a spaced apart relationship; and a step feature positioned adjacent a center flange of the pair of flanges;

a coil wound about the wall in a location between the pair of flanges; and a magnetic circuit comprising a plurality of actuator components that are positioned at least partially within the interior volume of the housing and are positioned on or adjacent to the bobbin, the plurality of actuator components including:

a permanent magnet that induces a magnetic flux through the magnetic circuit so as to generate a magnetic force;

an armature selectively movable within an opening formed through the bobbin responsive to the magnetic force and to a current selectively provided to the coil; and a top plate positioned adjacent an upper end of the housing;

a bottom plate positioned adjacent a lower end of the housing;

a tube positioned adjacent the top plate and radially outward from the bobbin in a gap formed between an end of each of the pair of flanges and the housing; and a flux transfer plate that, along with the permanent magnet and the center flange of the bobbin, form a stacked arrangement of the flux transfer plate, permanent magnet, and center flange;

wherein the magnetic flux flows axially through a flow path formed by the plurality of actuator components of the magnetic circuit; and wherein the bobbin locates and centers the plurality of components of the magnetic circuit about the central axis and provides a bearing surface for the armature as it moves within the opening formed through the bobbin.

23. The electromagnetic actuator of claim 1 wherein an outer circumference of the permanent magnet is greater than an outer circumference of the bobbin.

* * * * *